US010827820B2

(12) United States Patent
Hashim

(10) Patent No.: US 10,827,820 B2
(45) Date of Patent: Nov. 10, 2020

(54) DEVICE FOR KEEPING EYE GLASSES ON PERSON

(71) Applicant: Bilal H. Hashim, Troy, MI (US)

(72) Inventor: Bilal H. Hashim, Troy, MI (US)

( * ) Notice: Subject to any disclaimer, the term of this patent is extended or adjusted under 35 U.S.C. 154(b) by 0 days.

(21) Appl. No.: 15/587,210

(22) Filed: May 4, 2017

(65) Prior Publication Data

US 2018/0317637 A1 Nov. 8, 2018

(51) Int. Cl.
*A45F 5/02* (2006.01)

(52) U.S. Cl.
CPC ..... *A45F 5/02* (2013.01); *A45F 2005/023* (2013.01); *A45F 2200/0541* (2013.01)

(58) Field of Classification Search
CPC ..... A45F 5/02
See application file for complete search history.

(56) References Cited

U.S. PATENT DOCUMENTS 586,177 A * 7/1897 Grapes ..... B42F 1/08 24/546
660,990 A * 10/1900 Houghton ..... B42F 1/08 24/546
758,547 A * 4/1904 Mapother ..... B42F 1/08 24/552
763,303 A * 6/1904 Mayers ..... B42F 1/04 24/547
823,704 A * 6/1906 Simpson ..... A47G 21/165 24/8
826,334 A * 7/1906 Hickok ..... A47G 21/165 24/8
836,458 A * 11/1906 Peters ..... A47G 21/165 24/8
1,361,056 A * 12/1920 Hickman ..... A45F 5/04 248/214
1,390,083 A * 9/1921 Bowen ..... A47G 21/165 24/7
1,396,513 A 11/1921 Holcomb
2,313,859 A * 3/1943 Anderson ..... B21F 45/00 140/71 R
2,463,079 A * 3/1949 Albrecht ..... A41F 19/00 24/546
2,642,638 A * 6/1953 Larrabee ..... B42F 1/08 24/350
2,838,817 A * 6/1958 Wills ..... B42F 1/08 24/67.9
2,894,301 A * 7/1959 Scott ..... F16B 5/125 24/291
3,025,650 A * 3/1962 Nels ..... E04B 2/7457 52/357
3,234,616 A * 2/1966 Wantland ..... E04B 9/22 24/27
3,333,307 A * 8/1967 Wheeler ..... A47G 33/10 24/598.6

(Continued)

FOREIGN PATENT DOCUMENTS

CA 2 285 895 C 3/2006
EP 1 143 821 B1 4/2004

*Primary Examiner* — Jason W San
(74) *Attorney, Agent, or Firm* — Howard & Howard Attorneys PLLC

(57) ABSTRACT

An eye glasses holding device includes a first portion adapted to attach to a garment and a second portion coupled to the first portion and adapted to hold eye glasses.

5 Claims, 3 Drawing Sheets

(56) References Cited

U.S. PATENT DOCUMENTS 3,530,545 A * 9/1970 Lengyel ..... A47G 33/10 24/373
4,170,052 A * 10/1979 Okerblom ..... B42F 1/08 24/552
4,324,025 A * 4/1982 Apri ..... B42F 1/08 24/551
4,497,091 A * 2/1985 Elliott ..... B42F 1/08 24/30.5 T
4,942,646 A * 7/1990 Sebastian ..... A47G 25/92 24/40
5,042,191 A * 8/1991 Fett ..... A01K 91/04 24/552
5,078,484 A 1/1992 Vaughn
5,210,912 A * 5/1993 Hoefkes ..... F16G 11/046 24/129 C
5,214,825 A * 6/1993 Hirzel ..... B42F 1/02 24/547
5,319,835 A * 6/1994 Chao ..... B42F 1/08 24/546
5,492,297 A * 2/1996 Underwood ..... A47G 25/743 248/215
5,647,099 A 7/1997 Cohen
5,655,266 A * 8/1997 Gish ..... B42F 1/08 24/67.3
D384,186 S * 9/1997 Teaman ..... D2/643
5,806,149 A * 9/1998 Schultz ..... F16B 2/248 24/291
5,860,191 A 1/1999 Sieger
5,864,924 A 2/1999 Rodriguez
6,026,658 A 2/2000 Weller
6,076,925 A 6/2000 Kraut
6,260,749 B1 7/2001 Horovitz
6,330,962 B1 12/2001 Rodriguez
D457,931 S * 5/2002 Kalat ..... D21/776
6,449,807 B1 * 9/2002 Langkammerer ..... A45F 5/04 24/67.9
6,533,414 B2 3/2003 Newler
7,389,966 B1 * 6/2008 Hunter ..... A47G 29/083 248/304
7,448,155 B2 * 11/2008 Dolas ..... A45C 1/06 150/137
7,543,726 B2 * 6/2009 MacNaughton ..... A45F 5/02 224/268
D649,348 S * 11/2011 Murphy, Jr. ..... D3/266
D661,091 S * 6/2012 Murphy, Jr. ..... D3/266
D707,444 S * 6/2014 Murphy, Jr. ..... D3/266
8,925,157 B2 * 1/2015 O'Daniel ..... B42F 1/08 24/67.9
9,066,575 B2 * 6/2015 Lee-Holowka ..... A45F 5/02
9,341,203 B1 * 5/2016 Disharoon ..... F16B 2/248
D779,199 S * 2/2017 Murphy, Jr. ..... D3/266
9,591,912 B2 * 3/2017 Lee-Holowka ..... A45F 5/00
2002/0170147 A1 * 11/2002 Heller ..... A45F 5/02 24/3.3
2003/0014845 A1 * 1/2003 Harrison ..... A45F 5/00 24/3.3
2003/0131449 A1 * 7/2003 McCormack ..... A44C 25/00 24/3.4
2004/0093702 A1 * 5/2004 Mallicoat ..... A45F 5/04 24/546
2005/0241115 A1 * 11/2005 Zoullas ..... A44C 15/003 24/3.3
2006/0219743 A1 * 10/2006 Gallagher ..... A45F 5/02 224/192
2006/0237498 A1 * 10/2006 Piatt, Sr. ..... A45F 5/02 224/269
2009/0025186 A1 * 1/2009 Lee-Holowka ..... A45C 11/04 24/3.3
2009/0108040 A1 * 4/2009 Corzine ..... A45F 5/02 224/666
2009/0126159 A1 * 5/2009 Murphy, Jr. ..... A45F 5/00 24/3.3
2010/0044405 A1 * 2/2010 Albert ..... A45F 5/02 224/666
2011/0253759 A1 * 10/2011 Scalese ..... A45D 20/14 224/660
2015/0007375 A1 * 1/2015 Lee-Holowka ..... A45F 5/02 2/69
2015/0201725 A1 * 7/2015 Kljajic ..... A45F 5/02 248/213.2
2016/0025996 A1 * 1/2016 Bacon ..... G02C 3/04 24/3.3
2017/0181531 A1 * 6/2017 Alexis ..... A45F 5/02
2017/0238684 A1 * 8/2017 Cureington ..... A45F 5/02

* cited by examiner

DEVICE FOR KEEPING EYE GLASSES ON PERSON

BACKGROUND OF THE INVENTION

1. Field of the Invention

The present invention relates generally to eye glasses and, more particularly, to a device for keeping eye glasses on your person.

2. Description of the Related Art

Typical eyeglasses consist of a frame body that houses two lenses on either side of a nose piece. Attached to the frame body are two temple bars that extend from two ends of the frame body. The temple bars pivot between an open position perpendicular with the frame body and a closed position parallel with the frame body. Sometimes attached to the temple bars are separate ear pieces, or temple tips. The temple bars and nose piece support the frame on the head of the wearer.

Most individuals remove their eyeglasses temporarily. They may not recall where they left them, they may hang them around their neck where they bounce against their chest, or they may put them in a pocket and have them fall out and/or get damaged. It is, therefore, desirable to allow an individual to attach their eye glasses to their clothing when the eye glasses are not in use.

To solve this problem, the prior art discloses using mechanical clasps to clip eyeglasses to a garment worn by the user or to use magnetic devices to attach the eye glasses to one's garment, a clip to secure the eyeglasses to a lapel of clothing, a fixed jaw pivoted with a movable jaw and a mounting ring connected to the base for supporting the eyeglasses, an eyeglass holder attachable to an article of clothing worn by the user for suspending a pair of glasses facing upwardly and supported by the bridge of the eyeglasses to hold the eye glasses parallel to the garment, or a looped-shaped member where eye glasses can be hung. The mechanical clasps and magnets are cumbersome and, like all mechanical clasps and magnets, both may come loose. Some mechanical clasps, clips, jaws, suspensions, or looped shaped members all depend on the availability of a shirt pocket, a cap visor, belt, holder, straps, or the like.

Although, clips may work well initially, they fatigue, weaken and lose their ability to hold eyeglasses securely. Similarly, magnets can lose their retention force overtime and can also cause damage to the garment if accidentally left in a wash. Moreover, clips can break; thereby causing the eyeglasses to come loose, fall and break, or be lost. Therefore, there is a need in the art to provide a device that overcomes the limitations of the prior art by allowing the eye glasses to be secured around a button on a garment to hold the eye glasses when they are not in use.

SUMMARY OF THE INVENTION

The present invention provides a device to allow eye glasses to be secured around a button on a garment. An eye glasses holding device includes a first portion adapted to attach to a garment and a second portion coupled to the first portion and adapted to hold eye glasses.

One advantage of the present invention is that the device securely fits onto buttons of various diameters and hold the eye glasses when not in use. Another advantage of the present invention is that, since this device is located on the garment, the person who owns it will move it from one garment to another during the normal course of changing one's garment.

Other advantages of the present invention will be readily appreciated as the same becomes better understood by reference to the following detailed description when considered in connection with the accompanying drawings.

DESCRIPTION OF THE PREFERRED EMBODIMENT(S)

The eye glasses holder of the present invention allows for eye glasses to be carried safely and securely on one's person. Most people who do not need to wear eye glasses all the time tend to forget where they left their eye glasses and waste time searching for them. The purpose of this invention is to allow people to carry their glasses on their person safely and securely during the day while conducting their normal activities without the need for cumbersome claps that lose their retention over time or magnets that are difficult to position and could easily destroy the garment if left on the garment when the garment is put into the washer. The present invention described herein will overcome at least some disadvantages of known eye glasses holding devices by providing a non-magnetic, unitary device for eye glasses holding. By providing a device that is coupled to one another in such a way, the present invention provides a use that overcomes the disadvantages of the other known eye glasses holding devices.

Figure 1A:
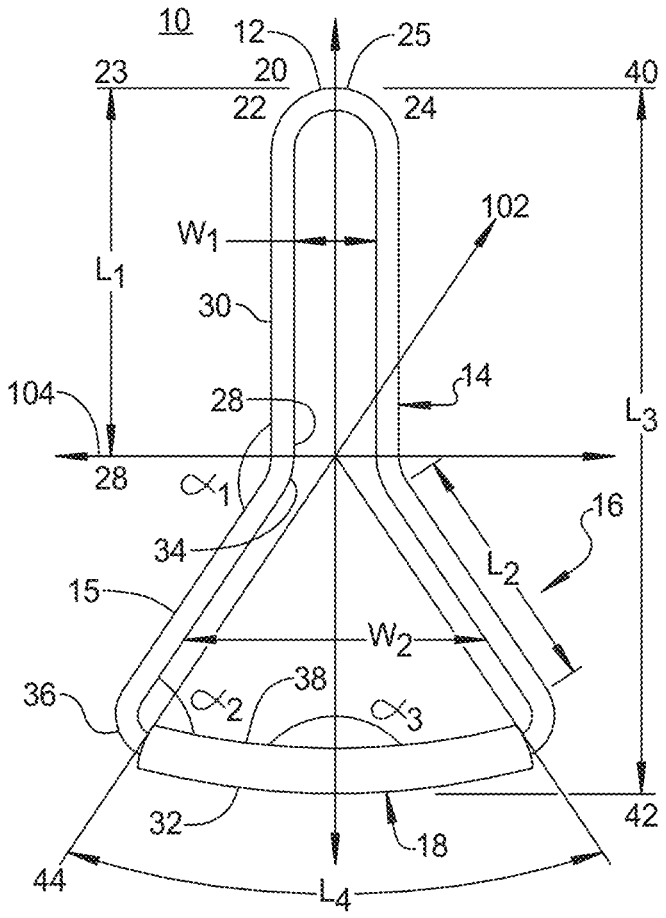
FIG. 1*a* is a front view of one embodiment of a device, according to the present invention, for keeping eye glasses on your person.
Figure 1B:
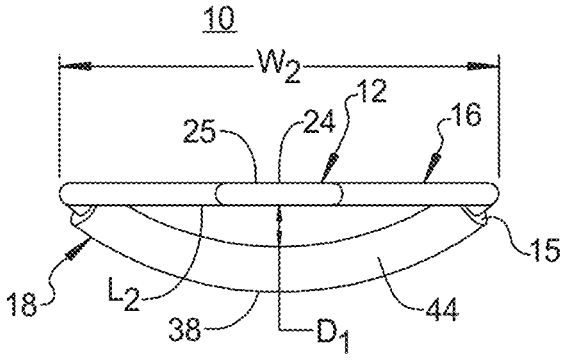
FIG. 1*b* is a top view of the device of FIG. 1*a*.
Figure 1C:
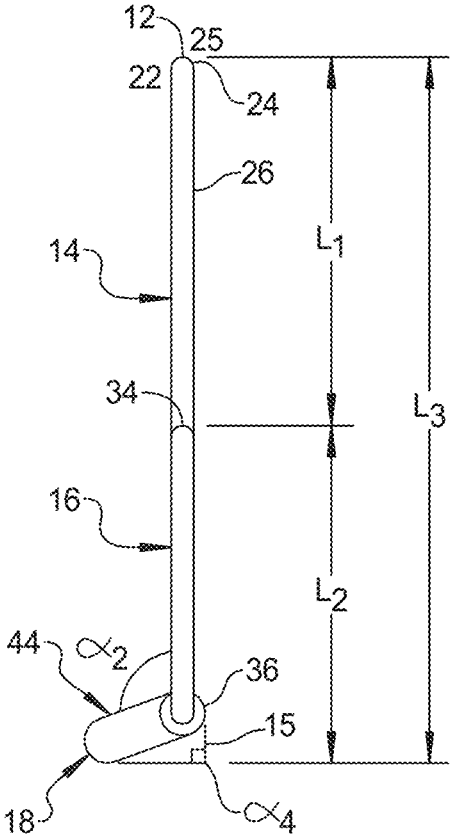
FIG. 1*c* is a side view of the device of FIG. 1*a*.

Referring to the drawings, FIGS. 1*a*-1*c*, one embodiment of an eye glasses holding device 10, according to the present invention, is shown. In the embodiment illustrated, the eye glasses holding device 10 includes a first portion 12 and a second portion 18. The first portion 12 has a recess 15 and includes a first pair of arms 14 and a second pair of arms 16. The first portion 12 includes a u-shaped loop 20 that sits on the top of the device 10, which is on a vertical axis 100 as shown in FIG. 1*a*. The vertical axis 100 is defined between the top 24 of the u-shaped loop 20 to the bottom 32 of the arcuate second portion 18. The top 24 of the u-shaped loop 20 forms a vertex 25. It should be appreciated that the vertex 25 is the highest point of the device at the top 24 of the u-shaped loop 20.

In one embodiment, the first pair of arms 14 are parallel to each other and are coupled to the elongated, u-shaped loop 20. The first pair of arms 14 are located in the direction of the vertical axis 100 at a predetermined distance 26. The first pair of arms 14 are extended outwardly from the bottom edges 22 of the u-shaped loop 20 such that the first pair of arms 14 have a length $L_1$, 26, measured between the top edge of the first pair of arms 23 and the bottom edge 28 of the first pair of arms 14. In addition, the first pair of arms 14 are located on a horizontal axis 104 at a predetermined distance 30, which is also known as the width between the first pair of arms 14, $W_1$.

The eye glasses holding device 10 also includes a second pair of arms 16 that diverge on a traverse axis 102 from the bottom 28 of the first pair of arms 14. The traverse axis 102 is the predetermined distance from the ray that runs along the top 34 of the second pair of arms 16 and the bottom 28 of the first pair of arms 14 to the bottom 36 of the second pair of arms 16. The traverse axis 102 creates an angle $\alpha_1$ between the bottom 28 of the first pair of arms 14 and the top 34 of the second pair of arms 16. This angle $\alpha_1$ is set at a predetermined angular distance between the first pair of arms 14 and the second pair of arms 16.

The second pair of arms 16 have a top 34 and a bottom 36. The second pair of arms 16 have a length $L_2$ that is defined as the distance between the top 34 and the bottom 36. The bottom 36 of the second pair of arms 16 creates an angle $\alpha_2$ with the arcuate second portion 18. The angle $\alpha_2$ is set at a predetermined angular distance between the second pair of arms 16 and the arcuate second portion 18. At the bottom 32 of the arcuate second portion 18 is the apex 38. The predetermined angular distance of the apex 38 has an angle $\alpha_3$. The apex 18 bisects the vertical axis 100 of the arcuate second portion 18. The width, $W_2$, between the second pair of arms 18 is set on the horizontal axis 104, wherein the width, $W_2$, will be the predetermined distance between the second pair of arms 18 set on the horizontal axis 104. The middle of $W_2$ bisects, forming a 90° angle, the vertical axis 100 allowing the width to be equidistant to both second pair of arms 18.

The length of the arcuate second portion 18 is $L_4$. The length, $L_4$, is the distance between the two bottoms 36 of the second pair of arms 18. The device 10 may include a tubular member 44 on the outside of the arcuate second portion 18. The tubular member 44 covers the entire arcuate second portion 18, running along the entire length, $L_4$. It should be appreciated that the tubular member 44 is optional.

In one embodiment, the eye glasses holding device 10 is congruent on both sides of the device 10. Both sides of the eye glasses holding device 10 is a mirror image of each other set on the vertical axis 100. On the vertical axis 100, the length of the eye glasses holding device is set at $L_3$ where the top 40 is the same as the top 24 of the u-shaped loop 12 and ends at the bottom 42, which is the same as the apex 38 of the arcuate second portion 18.

Referring to FIG. 1*c*, the second pair of arms 16 have a top 34 and a bottom 36. The second pair of arms 16 have a length $L_2$ that is defined as the distance between the top 34 and the bottom 36. The bottom 36 of the second pair of arms 16 creates an angle $\alpha_2$ with the arcuate second portion 18. The angle $\alpha_2$ is set at a predetermined angular distance between the second pair of arms 16 and the arcuate second portion 18. At the bottom 32 of the arcuate second portion 18 is the apex 38. The apex 18 runs along the vertical axis 100 of the arcuate second portion 18. The tubular material 44 on the outside of the arcuate second portion 18 is shown in FIG. 1*c*. The tubular material 44 runs along the entire length of the arcuate second portion 18.

There is an angle $\alpha$4 between the vertical axis 100 and the horizontal axis 102 that runs along the bottom 32 or the apex 38 of the arcuate second portion 18. The angle $\alpha$4 created by the two axis's is a 90° angle, where the hypotenuse is the arcuate second portion 18 of the eye glasses holding device 10.

Referring to FIG. 1*b*, the distance between the top 24 of the eye glass holding device 10 and the apex 38 of the second portion 38 has a depth $D_1$. The angle $\alpha_2$ is the distance between bottom 36 of the second pair of arms 16 and the second portion 18. It should be appreciated that the tubular material 44 is an option and not a limitation located on the second portion 18.

Moreover, the distance or width between the second pair of arms 18 is shown as $W_2$. The $W_2$ width is defined as the predetermined distance between the second pair of arms 18 set on the horizontal axis 104. The middle of $W_2$ bisects the horizontal axis 104 and is equidistant to both second pair of arms 18.

Figure 1D:
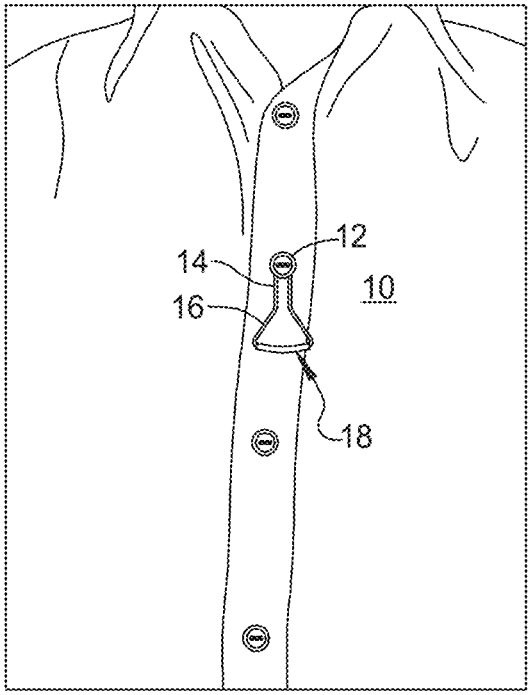
FIG. 1*d* is a front view of the device of FIG. 1*a* illustrated on a garment.
Figure 1E:
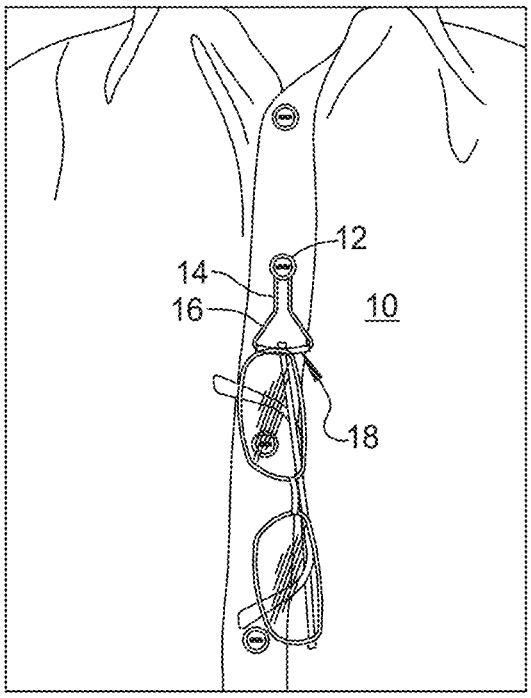
FIG. 1*e* is a front view of the device of FIG. 1*a* illustrated on a garment with eye glasses.

Referring to FIGS. 1*d*-1*e*, in operation, the eye glasses holding device 10 is hanging on a garment. Here the person is able to easily see the eye glasses holding device 10 and will remove the device when changing shirts. The user of the present invention will be able to tell where their glasses are and will not lose, break or forget the eye glasses anywhere. Moreover, because the present invention is so visible to the wearer, the device 10 will not be left on clothing before going into the wash. Here, the device 10 will eliminate breakage of not only the glasses but also of the invention itself.

Figure 2A:
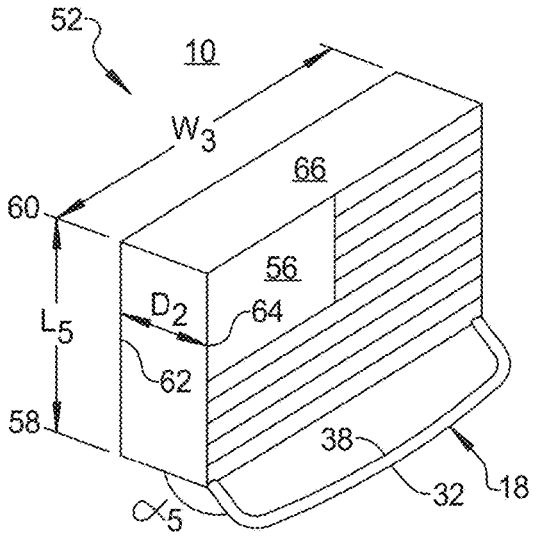
FIG. 2*a* is a front perspective view of another embodiment, according to the present invention, of the device of FIGS. 1*a*-1*c* for keeping eye glasses on your person.
Figure 2B:
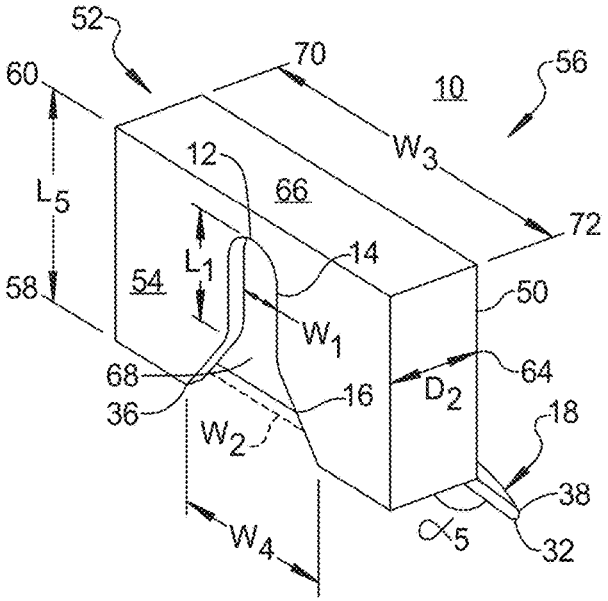
FIG. 2*b* is a rear perspective view of the device of FIG. 2*a*.

Referring to FIGS. 2*a* and 2*b*, another embodiment, according to the present invention of the device 10 is shown. In the illustrated embodiment, the eye glasses holding device 10 includes a first portion 12 and a second portion 18. The first portion 12 has a recess 15 and includes a first pair of arms 14 and a second pair of arms 16. The first portion 12 includes a u-shaped loop 20 that sits on the top of the device, which is on a vertical axis 100 as shown in FIG. 2*b*. The vertical axis is defined between the top 24 of the u-shaped loop 20 to the bottom 32 of the arcuate second portion 18. The first pair of arms 14 are parallel to each other and are coupled to the elongated, u-shaped loop 12. The first pair of arms 14 are located at a predetermined distance 30 on a horizontal axis 104. The predetermined distance 30 is also known as the width between the first pair of arms 14, $W_1$. The third portion 52 is a prism 50.

The third portion 52 includes a front wall 56, a rear wall 54 and a plurality of sides 66 that extend between the front wall 56 and rear wall 54 of the third portion 52. Each side 66 includes a bottom edge 58 and a top edge 60 that define a length, $L_5$. The front wall 56 and the rear wall 54 also have the same length, $L_5$, with a bottom edge 58 and a top edge 60.

In addition, the plurality of sides 66 includes a depth, $D_2$, that extends between the front wall 56 and the rear wall 54 of the third portion 52. $D_2$ is a predetermined distance between the side edge 62 that is along the rear wall 54 of the third portion 52 and the side edge 64 that is along the front wall 56 of the third portion 52.

In the embodiment illustrated, the prism 50 is formed having 5-sides and includes a rear wall 54, a front wall 56, and three sides 66 extending between the rear wall 54 and the front wall 56. The side walls 66 are coupled to the rear wall 54 and the front wall 56. More specifically, the prism 50 includes a rear wall 54, a front wall 56, and a plurality of side walls 66. The side walls 66 extend perpendicularly between the front wall 56 and the rear wall 54 such that the cavity 68 extends along a three dimensional axis defined between the rear wall 54 and the front wall 56. The width, $W_3$, of the side walls 66 is set at a predetermined distance between edges 70 and 72. The predetermined distance of the width, $W_3$, is measured along the horizontal axis 104.

The first portion 12 is located on the rear wall 54 of the third portion. The rear wall 54 has a hole that is the size of the first portion 12. The depth, $D_3$, of the rear wall 54 where the first portion 12 is located is the approximately the predetermined distance as shown in FIG. 2*a*.

In addition, the first pair of arms 14 are extended outwardly from the bottom edges 22 of the u-shaped loop 20 such that the first pair of arms 14 have a length $L_1$, 26, measured between the top edge of the first pair of arms 23 and the bottom edge 28 of the first pair of arms 14. The top 24 of the u-shaped loop 20 forms a vertex 25. The vertex 25 is the highest point of the first portion 12 at the top 24 of the u-shaped loop 20.

The eye glasses holding device 10 also includes a second pair of arms 16 that diverge on a traverse axis 102 from the bottom 28 of the first pair of arms 14. The traverse axis is defined from the ray that runs along the top 34 of the second set of arms 16 and the bottom 28 of the first pair of arms 14 to the bottom 36 of the second pair of arms 16. The traverse axis 102 creates an angle $\alpha 1$ between the bottom 28 of the first pair of arms 14 and the top 34 of the second pair of arms 16. This angle $\alpha 1$ is set at a predetermined angular distance between the first pair of arms 14 and the second pair of arms 16.

The second pair of arms 16 have a top 34 and a bottom 36. The second pair of arms 16 have a length $L_2$ that is defined as the distance between the top 34 and the bottom 36. Within the prism 50, there is a gap the size of the first portion 12, the first pair of arms 14, and the second pair of arms 16 that is in the rear 54 of the prism. In addition, the rear wall 54 is has a spaced distance 74 from bottom edges 36 of the second pair of arms 18 that is along the horizontal axis 104. Moreover, the gap 74 is a predetermined distance along the horizontal axis 104 between the two bottom edges 36 of the second pair of arms 18.

The bottom 58 of the front wall 56 of the third portion creates an angle as with the arcuate second portion 18. The angle as is set at a predetermined distance between the bottom 58 of the front wall 56 and the arcuate second portion 18. At the bottom 32 of the arcuate second portion 18 is the apex 38. The apex 38 runs along the vertical axis 100 of the arcuate second portion 18.

The width, $W_2$, between the second pair of arms 18 is set on the horizontal axis 104; where the width, $W_2$, will be the predetermined distance between the second pair of arms 18 set on the horizontal axis 104. The middle of $W_2$ bisects, forming a 90° angle, the vertical axis 100 allowing the width to be equidistant to both second pair of arms 18.

The device 10 may include a tubular member 44 on the outside of the arcuate second portion 18. The tubular member 44 covers the entire arcuate second portion 18, running along the entire length, $L_7$. The tubular member 44 is not a limitation but an option. The length of the arcuate second portion 18 is $L_7$. The length, $L_7$, is the distance between the mirror bottoms 32 of the front wall 56 of the third portion 52. The angular distance of the apex 38 has an angle $\alpha_3$.

The eye glasses holding device 10 is congruent on both sides of the device. The eye glasses holding device 10 is a mirror image set on the vertical axis 100. On the vertical axis 100, the length of the eye glasses holding device 10 is set at $L_6$ where the top 60 begins at the top side 66 of the prism 50 and ends at the bottom 32 at the apex 38 of the arcuate second portion 18.

Figure 3A:
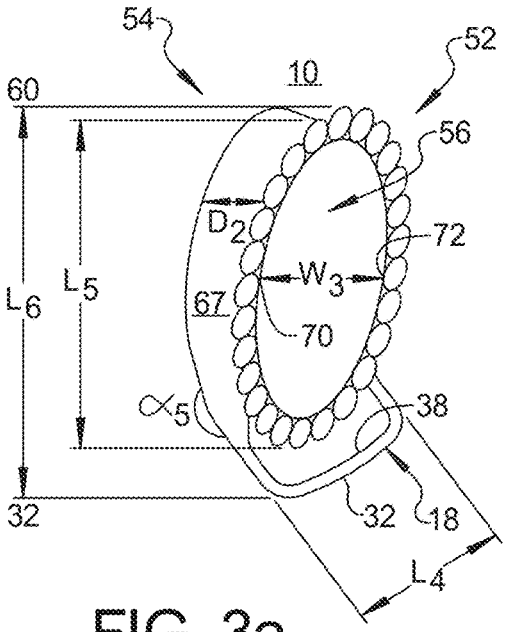
FIG. 3*a* is a front perspective view of yet another embodiment, according to the present invention of the device of FIGS. 1*a*-1*c* for keeping eye glasses on your person.
Figure 3B:
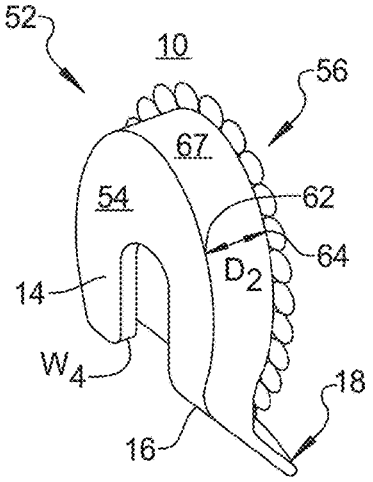
FIG. 3*b* is a rear perspective view of the device of FIG. 3*a*.

Referring to FIGS. 3*a* and 3*b*, yet another embodiment, according to the present invention, of the device 10 is shown. In the illustrated embodiment, the eye glasses holding device 10 includes a first portion 12 and a second portion 18. The first portion 12 has a recess 15 and includes a first pair of arms 14 and a second pair of arms 16. The first portion 12 includes a u-shaped loop 20 that sits on the top of the device, which is on a vertical axis 100 as shown in FIG. 2*b*. The vertical axis is defined between the top 24 of the u-shaped loop 20 to the bottom 32 of the arcuate second portion 18. The first pair of arms 14 are parallel to each other and are coupled to the elongated, u-shaped loop 12. The first pair of arms 14 are located at a predetermined distance 30 on a horizontal axis 104. The predetermined distance 30 is also known as the width between the first pair of arms 14, $W_1$. The third portion 52 is a round three-dimensional member 53.

The third portion 52 includes a front wall 56, a rear wall 54 and a round side 67 that extends between the front 56 and rear 54 of the third portion 52. From the top 80 of the broach to the bottom edge 58 of the third portion 52 is a set predetermined distance, $L_5$. The front wall 56 and the rear wall 54 also have the same length, $L_5$, with a bottom edge 58 and a top edge 60.

The round side 67 includes depth, $D_2$, that extends between the front wall 56 and the rear wall 54 of the third portion 52. $D_2$ is a predetermined distance between the side edge 62 that is along the rear wall 54 of the third portion 52 and the side edge 64 that is along the edge of the front wall 56 of the third portion 52.

In FIG. 3*a* and FIG. 3*b*, the third portion is formed having a rounded side 67 and includes a rear wall 54 and a front wall 56. The round side 67 extends between the rear wall 54 and the front wall 56. The round side wall 67 is coupled to the rear wall 54 and the front wall 56. The round side wall 67 extends perpendicularly between the front wall 56 and the rear wall 54 such that the cavity 68 extends along a three dimensional axis at a predetermined distance between the rear wall 54 and the front wall 56. The width, $W_3$ of the rounded side wall 67 is set at a predetermined distance between edges 70 and 72. The predetermined distance of the width, $W_3$, is measured along the horizontal axis 104.

The bottom 58 of the front wall 56 of the third portion 52 forms an angle as with the arcuate second portion 18. The angle as is set at a predetermined distance between the bottom 58 of the front wall 56 and the arcuate second portion 18. At the bottom 32 of the arcuate second portion 18 is the apex 38. The apex 18 runs along the vertical axis 100 of the arcuate second portion 18.

The device 10 may include a tubular member 44 on the outside of the arcuate second portion 18 and covers the entire arcuate second portion 18. The tubular member 44 is an option and not a limitation on the embodiment. The length of the arcuate second portion 18 is $L_7$. The length, $L_7$, is the distance between the mirror bottoms 32 of the front wall 56 of the third portion 52. The angular distance of the apex 38 has an angle $\alpha_3$.

The eye glasses holding device 10 is congruent on both sides of the device. The eye glasses holding device 10 is a mirror image set on the vertical axis 100. On the vertical axis 100, the length of the eye glasses holding device 10 is set at $L_6$ where the top 60 begins at the top side 66 of the prism 50 and ends at the bottom 32 at the apex 38 of the arcuate second portion 18.

The present invention has been described in an illustrative manner. It is to be understood that the terminology, which has been used, is intended to be in the nature of words of description rather than of limitation.

Many modifications and variations of the present invention are possible in light of the above teachings. Therefore, the present invention may be practiced other than as specifically described.

What is claimed is:

1. An eye glasses holding device comprising:

a first portion having a top forming an inverted U-shape recess with a vertical axis and adapted to be disposed over a button of a garment, the first portion having first sides extending downwardly from the top in a direction of the vertical axis and parallel to the vertical axis and spaced transversely from the vertical axis forming a first width adapted to be less than a width of the button, the first portion having second sides extending outwardly from a bottom of the first sides and diverging downwardly and transversely away from the vertical axis forming a second width, wherein the second sides form a triangular shape, the first width being less than the second width, the first sides, the top, and the recess extending and laying in a first plane; and a second portion extending outwardly and forwardly and spaced away from a bottom of the second sides of the first portion to form an arcuate shaped closed member having a third width and an apex bisecting the vertical axis and the second portion not recontacting the second sides from the bottom of the second sides to the apex, the third width being the same as the second width, the second portion laying in a second plane different from the first plane, the second portion forming the closed member with the first portion having a space therebetween, the second portion being adapted to hold eye glasses, and the space between the top and the apex having a depth adapted to allow for a thickness of temple arms of the eye glasses to stay formed near a body of a user preventing hinges of the eye glasses from opening.

2. An eye glasses holding device as set forth in claim 1 wherein the first portion has a length greater than a length of the second portion.

3. An eye glasses holding device as set forth in claim 1 wherein the second portion includes a member disposed about a portion thereof, wherein the member is tubular.

4. An eye glasses holding device as set forth in claim 1 wherein the first portion and the second portion are integral, unitary, and one piece.

5. An eye glasses holding device comprising:

a first portion having a top forming an inverted U-shape recess with a vertical axis and adapted to be disposed over a button of a garment, the first portion having first sides extending downwardly from the top in a direction of the vertical axis and parallel to the vertical axis and spaced transversely from the vertical axis forming a first width adapted to be less than a width of the button, the first portion having second sides extending outwardly from a bottom of the first sides and diverging downwardly and transversely away from the vertical axis forming a second width, wherein the second sides form a triangular shape, the first width being less than the second width, the first sides, the top, and the recess laying and extending in a first plane; and a second portion extending outwardly and forwardly and spaced away from a bottom of the second sides of the first portion to form an arcuate shaped closed member having a third width and an apex bisecting the vertical axis and the second portion not recontacting the second sides from the bottom of the second sides to the apex, the third width being the same as the second width, the second portion laying in a second plane different from the first plane, the second portion forming the closed member with the first portion having a space therebetween, the second portion being adapted to hold eye glasses the space distance between the top and the apex having a depth adapted to allow for a thickness of temple arms of the eye glasses to stay formed near a body of a user preventing hinges of the eye glasses from opening, the first portion has a length greater than a length of the second portion, the second portion includes a member disposed about a portion thereof, the member is tubular, and the first portion and the second portion are integral, unitary, and one piece.

* * * * *